US010179717B2

(12) United States Patent
Scoville et al.

(10) Patent No.: US 10,179,717 B2
(45) Date of Patent: Jan. 15, 2019

(54) DESTINATION DISPATCH PASSENGER DETECTION

(71) Applicant: OTIS ELEVATOR COMPANY, Farmington, CT (US)

(72) Inventors: Bradley Armand Scoville, Farmington, CT (US); Paul A. Simcik, Farmington, CT (US); Tyler S. Brown, Emmaus, PA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/345,227

(22) Filed: Nov. 7, 2016

(65) Prior Publication Data

US 2018/0127235 A1 May 10, 2018

(51) Int. Cl.
*B66B 1/46* (2006.01)

(52) U.S. Cl.
CPC ..... *B66B 1/468* (2013.01); *B66B 2201/4607* (2013.01); *B66B 2201/4615* (2013.01); *B66B 2201/4653* (2013.01); *B66B 2201/4684* (2013.01)

(58) Field of Classification Search
CPC ..... B66B 1/468; B66B 2201/4607; B66B 2201/4615; B66B 2201/4653; B66B 2201/4684
USPC ..... 187/247; 181/247
See application file for complete search history.

(56) References Cited

U.S. PATENT DOCUMENTS 2,867,291 A * 1/1959 Pierson ..... B66B 13/143 187/317
3,967,702 A 7/1976 Iwaska et al.
4,030,572 A 6/1977 Kaneko et al.
4,044,860 A 8/1977 Kaneko et al.
5,255,341 A * 10/1993 Nakajima ..... B66B 1/468 340/573.1
5,511,635 A 4/1996 Kameli
5,952,626 A 9/1999 Zaharia
(Continued)

FOREIGN PATENT DOCUMENTS

JP H02305779 A 12/1990
JP H0616345 A 1/1994
(Continued)

OTHER PUBLICATIONS

English Abstract for JP2013049561A—Mar. 14, 2013; 2 pgs.
English Abstract for JPH02305779A—Dec. 19, 1990; 2 pgs.
English Abstract for WO2014171296A1—Oct. 23, 2014; 2 pgs.

*Primary Examiner* — David Warren
(74) *Attorney, Agent, or Firm* — Cantor Colburn LLP

(57) ABSTRACT

An elevator car destination dispatching system and methodology are disclosed. The system includes a user interface that is configured to permit a user of a plurality of users to enter a desired destination in a building. The system further includes a presence detector disposed in the vicinity of the user interface. The presence detector is configured to detect the presence of the user of the plurality of users at the user interface. The presence detector is also operably coupled to a controller. The controller is configured to dispatch an elevator car based on the desired destination entered by the user of the plurality of users and the presence of the user of the plurality of users in the vicinity of the user interface.

16 Claims, 3 Drawing Sheets

(56) References Cited

U.S. PATENT DOCUMENTS 6,109,396 A * 8/2000 Sirag ..... B66B 1/468 187/381
6,202,799 B1 3/2001 Drop
6,209,685 B1 4/2001 Zaharia et al.
6,257,373 B1 * 7/2001 Hikita ..... B66B 1/2458 187/387
6,382,363 B1 5/2002 Friedli
6,397,976 B1 6/2002 Hale et al.
7,500,544 B2 3/2009 Hakala et al.
7,717,238 B2 5/2010 Hamaji et al.
7,729,691 B2 * 6/2010 Newville ..... G06Q 30/0207 187/247
9,079,751 B2 7/2015 Sundholm et al.
9,802,789 B2 * 10/2017 Kim ..... B66B 5/0012
2003/0159890 A1 * 8/2003 Schuster ..... B66B 1/468 187/247
2003/0167464 A1 * 9/2003 Meyer ..... B66B 3/00 725/10
2008/0223667 A1 * 9/2008 Tinone ..... B66B 5/005 187/392
2008/0236956 A1 * 10/2008 Finschi ..... B66B 1/468 187/382
2009/0014254 A1 * 1/2009 Finschi ..... B66B 1/468 187/381
2009/0020370 A1 * 1/2009 Boss ..... B66B 1/468 187/247
2010/0006379 A1 * 1/2010 Hamaji ..... B66B 1/468 187/384
2010/0315208 A1 * 12/2010 Takeuchi ..... B66B 1/468 340/286.06
2012/0041593 A1 * 2/2012 Ichinose ..... B66B 1/2458 700/258
2012/0305340 A1 * 12/2012 Wu ..... B66B 1/34 187/381
2012/0305341 A1 * 12/2012 Kuoppala ..... B66B 1/468 187/382
2014/0132572 A1 * 5/2014 Rusanen ..... B66B 1/463 345/178
2015/0068849 A1 3/2015 Haipus et al.
2015/0114763 A1 * 4/2015 Kim ..... B66B 5/0012 187/392
2015/0183618 A1 * 7/2015 Kondo ..... B66B 1/468 187/380
2016/0214830 A1 7/2016 Simcik et al.
2016/0264149 A1 * 9/2016 VanBlon ..... B60W 50/0098
2017/0217727 A1 * 8/2017 Scoville ..... B66B 1/468
2017/0247224 A1 * 8/2017 Witczak ..... B66B 1/468
2017/0302909 A1 * 10/2017 Finn ..... H04N 13/0246
2017/0313546 A1 * 11/2017 King ..... B66B 1/2491
2017/0349402 A1 * 12/2017 Chapman ..... B66B 1/468
2017/0369278 A1 * 12/2017 Chapman ..... B66B 3/006

FOREIGN PATENT DOCUMENTS

JP 203049561 A 3/2013
WO 0164571 A1 9/2001
WO 2014171296 A1 10/2014
WO 2016014313 A1 1/2016

* cited by examiner

DESTINATION DISPATCH PASSENGER DETECTION

TECHNICAL FIELD

The present disclosure relates generally to elevator systems, and more particularly, to elevator control systems associated with destination dispatching.

BACKGROUND

Typically, destination dispatch elevator systems are used to provide elevator car assignments in response to a user's floor selection. For example, a destination dispatch system may provide an elevator car assignment or a list of potential elevator car assignments based on car usage and user demand. Advantageously, destination dispatch systems may improve elevator system efficiency and decrease user wait times.

Destination dispatch systems are often used with a variety of applications and users. Conventional destination dispatching systems rely on a time-based location method which assumes a travel time needed for an elevator car to move between floors. Certain applications and users often have different objectives, requirements, and desires. Current destination dispatch systems provide a calculated optimal car assignment by analyzing predetermined parameters, sometimes leading to car assignments that are not aligned with a user's preferences at a given time, such as desired car occupancy, wait time, and travel time.

Sometimes users will attempt to "trick" the destination management system by entering multiple fake requests for the same floor in an effort to increase the likelihood that a car assigned to the desired floor will arrive more rapidly, and include less travelers to other floors, thereby minimizing that particular user's overall travel time. Fake requests to the destination management system decrease occupancy and results in overall increases in wait times and travel times for other passengers.

SUMMARY

Described herein in an embodiment an elevator car destination dispatching system and methodology. The system includes a user interface that is configured to permit a user of a plurality of users to enter a desired destination in a building. The system further includes a presence detector disposed in the vicinity of the user interface. The presence detector is configured to detect the presence of the user of the plurality of users at the user interface. The presence detector is also operably coupled to a controller. The controller is configured to dispatch an elevator car based on the desired destination entered by the user of the plurality of users and the presence of the user of the plurality of users in the vicinity of the user interface.

In addition to one or more of the features described above, or as an alternative, further embodiments may include that the user interface includes at least one of an input device and a display. In addition, the input device may be at least one of a keypad, a touch screen, and a portable mobile device. Further yet, the user interface may include the presence detector.

In addition to one or more of the features described above, or as an alternative, further embodiments may include that the presence detector includes at least one of a touch sensor, proximity sensor, PIR sensor, motion detector, radar sensor, electric and magnetic field sensor, optical sensor, and a camera. Moreover, the touch sensor may be configured as a floor mat that a user stands on in the proximity of the user interface. In addition, the presence detector may be configured with a limited field of view.

In addition to one or more of the features described above, or as an alternative, further embodiments may include that the controller may be configured to determine if a second destination request has been made by the at least one user of the plurality of users while the presence detector detects the presence of the at least one user of the plurality of users. In addition, the controller may be configured to ascertain if the second destination request is different than the first destination request made by the at least one user of the plurality of users and if not, ignore the second destination request when dispatching the elevator car.

In addition to one or more of the features described above, or as an alternative, further embodiments may include that if the second destination request is different than the first destination request made by the at least one user of the plurality of users, the controller is configured to inquire of the at least one user of the plurality of users if a new destination is desired and if the at least one user of the plurality of users indicates that the new destination is desired, then dispatch an elevator car based on the new destination.

In addition to one or more of the features described above, or as an alternative, further embodiments may include an annunciator to provide the at least one user of the plurality of users information associated with the dispatched elevator car. Moreover, the information associated with the dispatched elevator car may be an assigned hoistway.

Also described herein in an embodiment is method of dispatching an elevator car in an elevator system. The method includes: receiving at a user interface a destination request indicative of a desired destination in a building from at least one user of a plurality of users; detecting a presence of the at least one user of the plurality of users in the vicinity of a user interface; and dispatching an elevator car based on the desired destination entered by at least one user of the plurality of users and the presence of the at least one user of the plurality of users in the vicinity of the user interface.

In addition to one or more of the features described above, or as an alternative, further embodiments may include determining if a second destination request has been made by the at least one of the plurality of users user during the detecting. In addition, the determining may include ascertaining if the second destination request is different than the first destination request made by the at least one user of the plurality of users and if not, ignoring the second destination request in the dispatching. Moreover, if the second destination request is different than the first destination request made by the at least one user of the plurality of users, the method may include inquiring of the at least one user of the plurality of users if a new destination is desired and if the at least one user of the plurality of users indicates that the new destination is desired, then dispatching an elevator car based on the new destination.

In addition to one or more of the features described above, or as an alternative, further embodiments may include annunciating to the at least one user of the plurality of users information associated with the dispatched elevator car. In addition, the information associated with the dispatched elevator car may include an assigned hoistway.

In addition to one or more of the features described above, or as an alternative, further embodiments may include that the detecting employs a presence detector including at least one of a touch sensor, proximity sensor, PIR sensor, motion detector, radar sensor, electric and magnetic field sensor, optical sensor, and a camera. In addition, the touch sensor may be configured as a floor mat that a user stands on proximal to the user interface.

Also described herein in another embodiment is a method of controlling an elevator destination dispatching system. The method includes: detecting a presence of at least one user of the plurality of users in the vicinity of a user interface, the user interface configured to permit the at least one user of the plurality of users to enter a destination request indicative of a desired destination in a building; and controlling the activity of a destination dispatching system based on the presence of the at least one user of the plurality of users in the vicinity of the user interface.

In addition to one or more of the features described above, or as an alternative, further embodiments may include that the controlling include collecting data based on the detected presence of the at least one user of the plurality of users in the vicinity of the user interface.

BRIEF DESCRIPTION OF THE DRAWINGS

The subject matter which is regarded as the disclosure is particularly pointed out and distinctly claimed in the claims at the conclusion of the specification. The foregoing and other features, and advantages of the disclosure are apparent from the following detailed description taken in conjunction with the accompanying drawings in which:

DETAILED DESCRIPTION OF THE EMBODIMENTS

Figure 1:
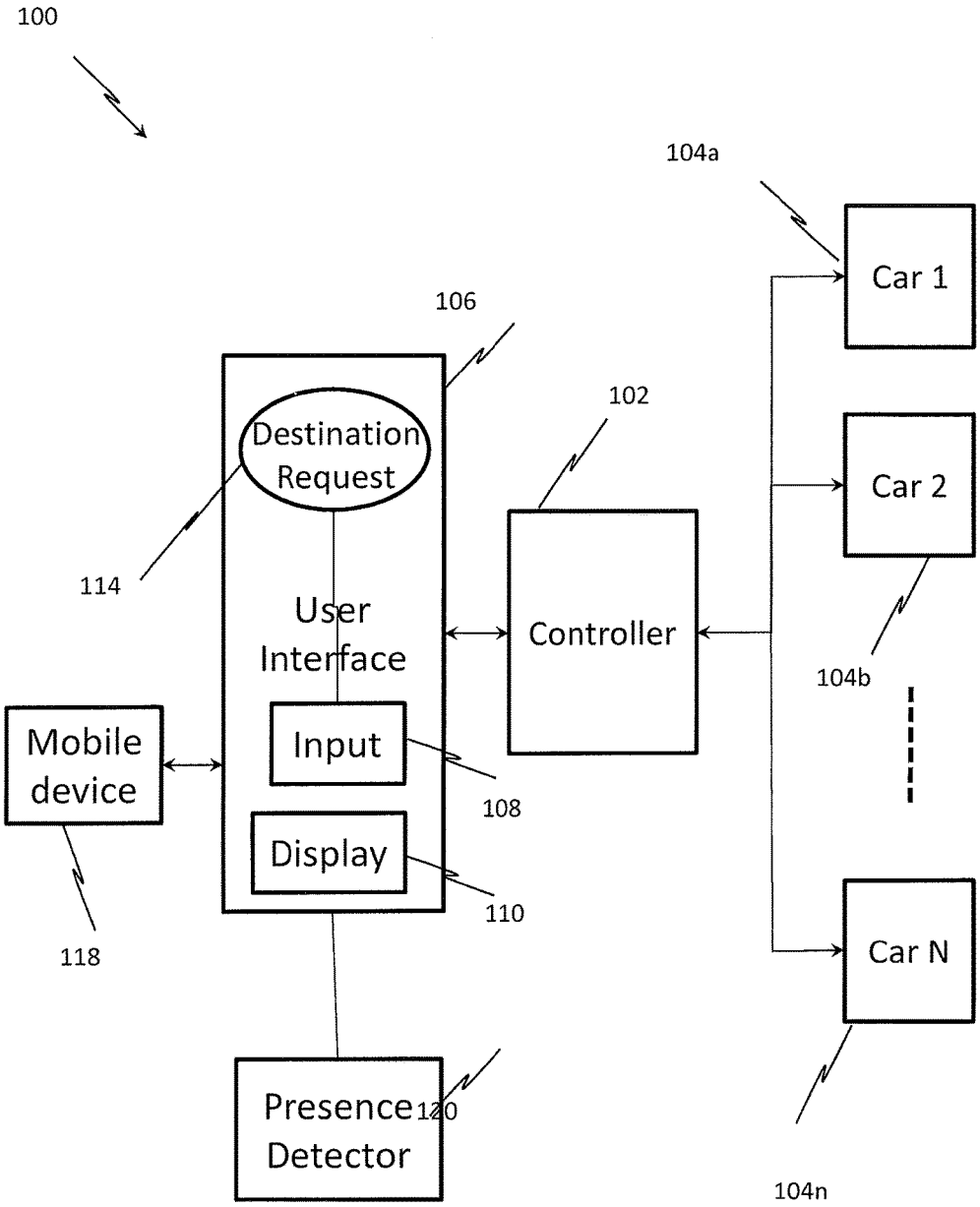
FIG. 1 is a block diagram of an elevator car dispatching system according to an embodiment.

The following description is merely illustrative in nature and is not intended to limit the present disclosure, its application or uses. It should be understood that throughout the drawings, corresponding reference numerals indicate like or corresponding parts and features. As used herein, the term controller refers to processing circuitry that may include an application specific integrated circuit (ASIC), an electronic circuit, an electronic processor (shared, dedicated, or group) and memory that executes one or more software or firmware programs, a combinational logic circuit, and/or other suitable interfaces and components that provide the described functionality.

Referring now to the drawings, FIG. 1 illustrates a schematic view of an elevator system 100 with destination management and route selection, also known as destination dispatching, in accordance with an embodiment of the disclosure. In an embodiment, elevator system 100 includes a controller 102 to provide destination dispatch routing with route selection functionality. Controller 102 also controls the operation of cars 104*a-n*. Controller 102 interacts with users via user interface 106.

User interface 106 allows a user to interface with the elevator system 100. Users may be individual users, such as an employee in a workplace, or a group of users with common preferences, such as employees all working the same shift on the same floor of a building with elevators. In an embodiment, elevator system 100 utilizes destination dispatch routing, which requires destination information before entering a car 104*a*-104*n*. In a destination dispatch system, the user selects their desired floor via a user interface 106. In an embodiment, user interface 106 is a physical interface. The user interface 106 may be located in a central kiosk, a sky lobby, an intermediate lobby of a building, or any other suitable location with an elevator system 100. In an alternative embodiment, user interface 106 is a virtual interface to allow users to enter and receive information through other devices, such as portable mobile devices 118, including but not limited to, cell phones, tablets or other alternative devices. In alternative embodiments, user interface 106 is a physical device that allows alternative interfacing via portable devices 118.

In an embodiment, user interface 106 receives information via input 108 for use by controller 102. In an embodiment, input 108 is a physical input, such as a keypad, touch screen, touch pad, mouse, or any other known user input device, to enter destination requests 114. In certain embodiments, input 108 also allows for the identification of users to allow the retrieval of corresponding user profiles. In certain embodiments, input 108 is a virtual input that allows communication from other suitable devices including mobile devices 118 to allow input of destination requests 114, identification of users and other user inputs.

In an embodiment, user interface 106 communicates elevator system 100 outputs via display 110. Display 110 may be a physical display that shows information such as identification confirmation, car assignment, system status, car status, and other relevant information. In certain embodiments, display 110 is a virtual display that outputs information to external devices, such as computers, televisions, external displays and mobile devices 118. In an embodiment, display 110 provides elevator system 100 status information, route options, and allows the user to see their car assignment in accordance with the route selection discussed herein.

In an embodiment, a user provides a destination request 114 via input 108. A destination request 114 may include information such as the source floor, destination floor, opening information, and any other suitable information required by the elevator system 100. In certain embodiments, a user can provide a destination request 114 via a physical keypad or otherwise fixed input methods, touchscreen, etc. as part of input 108. In other embodiments, a user can provide a destination request 114 via a mobile device 118.

Once the destination request 114 is received, the controller 102 determines which car 104*a*-104*n* that particular destination request 114 should be assigned to, and informs the user at the user interface 106. In an embodiment, the elevator system 100 may provide information via a mobile device 118. In an embodiment, the controller 102 may cause the user interface to provide feedback annunciations and information associated with the dispatched elevator car 104*a*-104*n* to the user. In one embodiment, the assigned hoistway and/or car are displayed. In another embodiment, the desired destination, or other information may be displayed on display 110, however other forms of informing the user of the assigned floor are possible, including additional displays, annunciators, and audible announcements and information provided to the mobile device 118. When the user makes the destination request 114 at the user interface 106 using input 108 the user may continue to enter a second request or even repeated requests 114 for the same floor.

In general, the controller 102 may receive one or more input signals/corresponding to each elevator car 104*a*-104*n* of the elevator system 100 to facilitate elevator system operations. The information includes, but is not limited to, car load, brake status, car door status, car input power, car calling status, service operation mode status, car weight, car position, and car emergency status, and input power status. Based on the information, the controller 102 determines the status of and provides commands to the elevator system 100 and/or the elevator cars 104*a*-104*n* included in the elevator system 100. Generally, destination dispatch routing functions in elevator systems 100, need only use a few parameters to determine car assignments for users. Such parameters may include the destination request 114 entered, the current state of cars 104*a*-104*n*, and other destination requests 114 entered by other users. As a result, the controller 102 may dispatch and assign cars 104*a*-104*n* based on not only the requests of other users, the state of the cars 104*a*-104*n*, but also on the previously mentioned "erroneous" multiple requests of the user. This results in inefficient scheduling and routing of the cars.

To address this concern and improve scheduling and routing in the elevator system 100 of an embodiment, one or more presence detectors 120 are also employed. In one embodiment the presence detector 120 detects the presence of a user while that person is at the user interface 106 using the input 108 to make a destination request 114. The presence detector 120 can be a standard proximity sensor, passive infrared (PIR) sensors, motion detectors, radar sensors, magnetic and electric field sensors, optical sensors, image and video, cameras and the like. Other presence detectors 120 might include touch sensitive sensors at the user interface 106, for example, touch sensitive detectors at the user input 108, on the display 110, or a floor mat that detects that a user is standing at the user interface 106. The presence detector 120 may be installed a variety of locations as may suit the application and environment where the user interface 106 is installed including as an integral part of the user interface 106 or controller 102. Preferably the presence detector 120 is installed so that its range and field of view are such that it limits false detections. Preferably still the presence detector may be installed to limit detection to a single user at the user interface. For example, with controlled range and field of view limited to detecting users directly facing the user interface 106. In another example, the presence detector 120 may be installed as a proximity detector above, below, or directed radially outwardly from the user input 106. In another embodiment, the presence detector 120 an optical or video camera installed above the user interface 106 and directed downward to limit detection of other users in the vicinity. Other embodiments may employ a combination of sensing technologies for the presence detector 120 to aid in eliminating false detections. In an embodiment, the controller 102 can dispatch and assign cars 104*a*-104*n* based upon the above described parameters of a conventional destination dispatch system, but also analyze the user presence and determine if the user has remained at the user interface 106 while entering a second or subsequent destination request 114.

In an embodiment, if a user remains at the user interface 106 and makes a second or subsequent destination request 114, and it is for a different floor than the first destination request 114, the controller 102 may then prompt the user to see if they want to cancel the first destination request 114. The user may have made a mistake with the first destination request 114, or may have elected to change their destination. In this instance, in an embodiment, the controller 102 accepts the second destination request 114 and employs the second destination request 114 for dispatching an elevator car 104*a*-104*n*. If the destination request 114 is for the same destination as previously entered, the controller 102 may instead elect to ignore the subsequent destination request 114 as erroneous, thereby reducing the required set of desired destinations and simplifying the destination dispatching and routing. In the destination dispatching system and method of an embodiment, no additional elevator car space, or routing is allocated to the additional redundant requests made while the user is at the user interface 106. Therefore, in an embodiment, controller 102 can assign cars 104*a*-104*n* to users based on a more accurate count of destination requests 114 without users making attempts to enter false destination requests 114.

In another embodiment, detecting the presence of the user at the user interface 106 presents numerous advantages. In certain embodiments, controller 102 may cause the display 110 to display the assigned elevator for a duration based on the user's presence at the user interface 106. For example, display for a longer duration if the user is still at the user interface. This can be advantageous, as users have in past systems forgotten the assigned elevator. Conversely, the controller 102 may be configured to cause the display 110 to change more rapidly if the presence detector 120 indicates that the user is no longer in the area of the user interface 106, thereby reducing the user to user queue time and increasing throughput at the user interface 106.

In yet another embodiment, the functionality of the user interface 106 may change as the presence detector 120 detects the presence or absence of a user. For example, the display 110 and/or input 108 of the user interface 106 may be enabled/disabled, display timing modified, or enters a wake/sleep mode when the presence detector 120 determines a user has arrived at/departed from the user interface 106. This feature can be advantageous during periods of light usage such as overnight, resulting in energy savings and reduced wear and tear on the components of the system 100.

In another embodiment, detecting the presence of the user at the user interface 106 presents several features and advantages not previously available with typical elevator systems 100 with destination management functions. In certain embodiments, controller 102 may collect and aggregate data regarding system usage at a user interface 106. In an embodiment, controller 120 may collect data regarding usage as a function of time, time of day, day of week, type of system, size of system and the like. This data can be aggregated and compared with data for other elevator systems 100 with destination management functionality to provide operational cost data, comparative results, predictive maintenance and other information of value to building owners, operators, and elevator maintenance.

Figure 2:
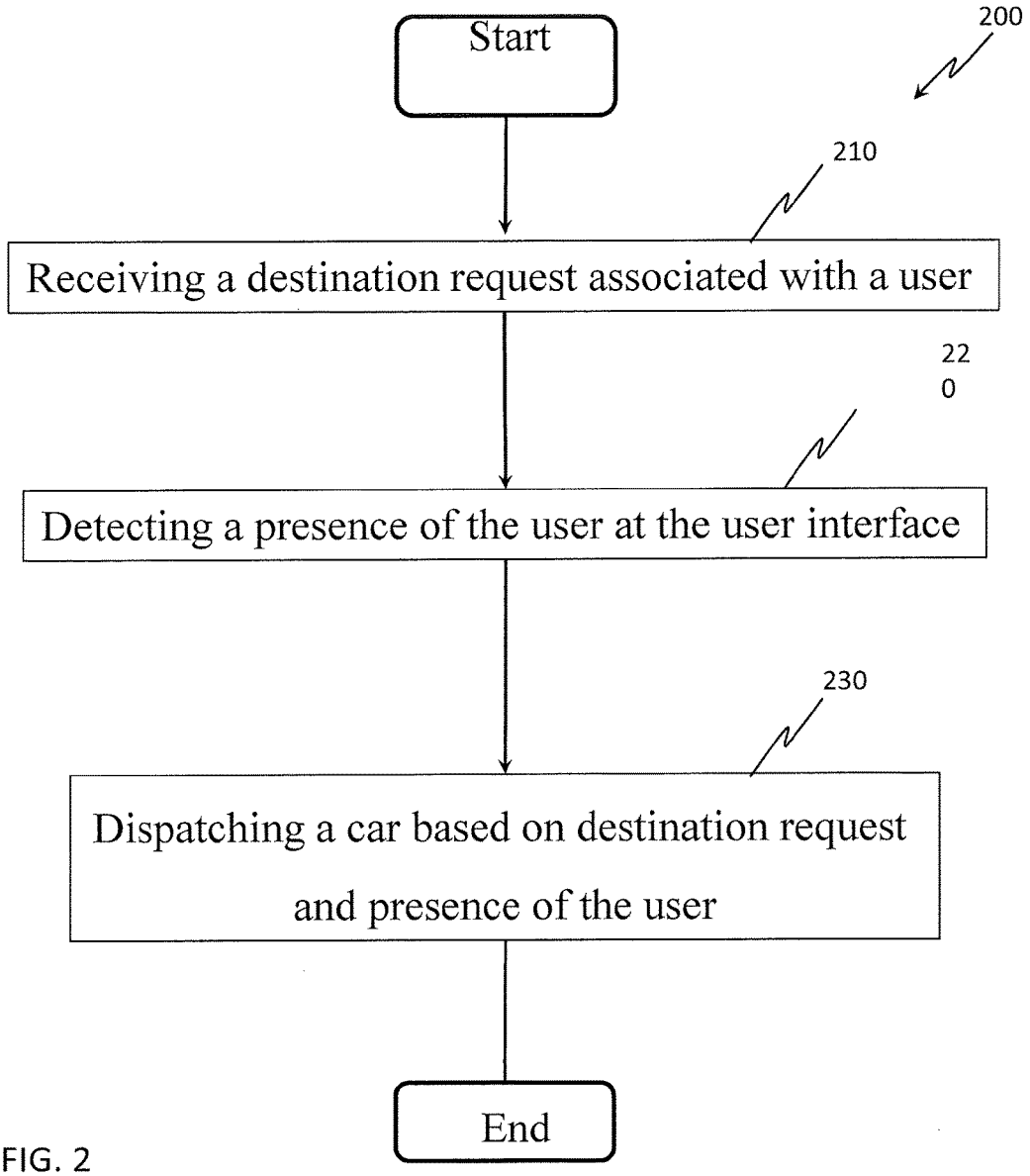
FIG. 2 depicts a method of dispatching an elevator car in an elevator system according to an embodiment.

Referring now to FIG. 2 as well, FIG. 2 illustrates a method 200 for destination dispatch in an elevator system 100 with user presence detection as described above herein. In an embodiment, in operation 210 a user inputs the destination request 114 indicative of the desired destination at the user interface 106. The presence detector 120, at operation 220, detects the presence of the user at the user interface 106 while the user is at the user interface 106. Finally at operation 230 the controller 102 dispatches a car for the user based on the user's destination request 114 and the presence detected at the user interface 106.

Figure 3:
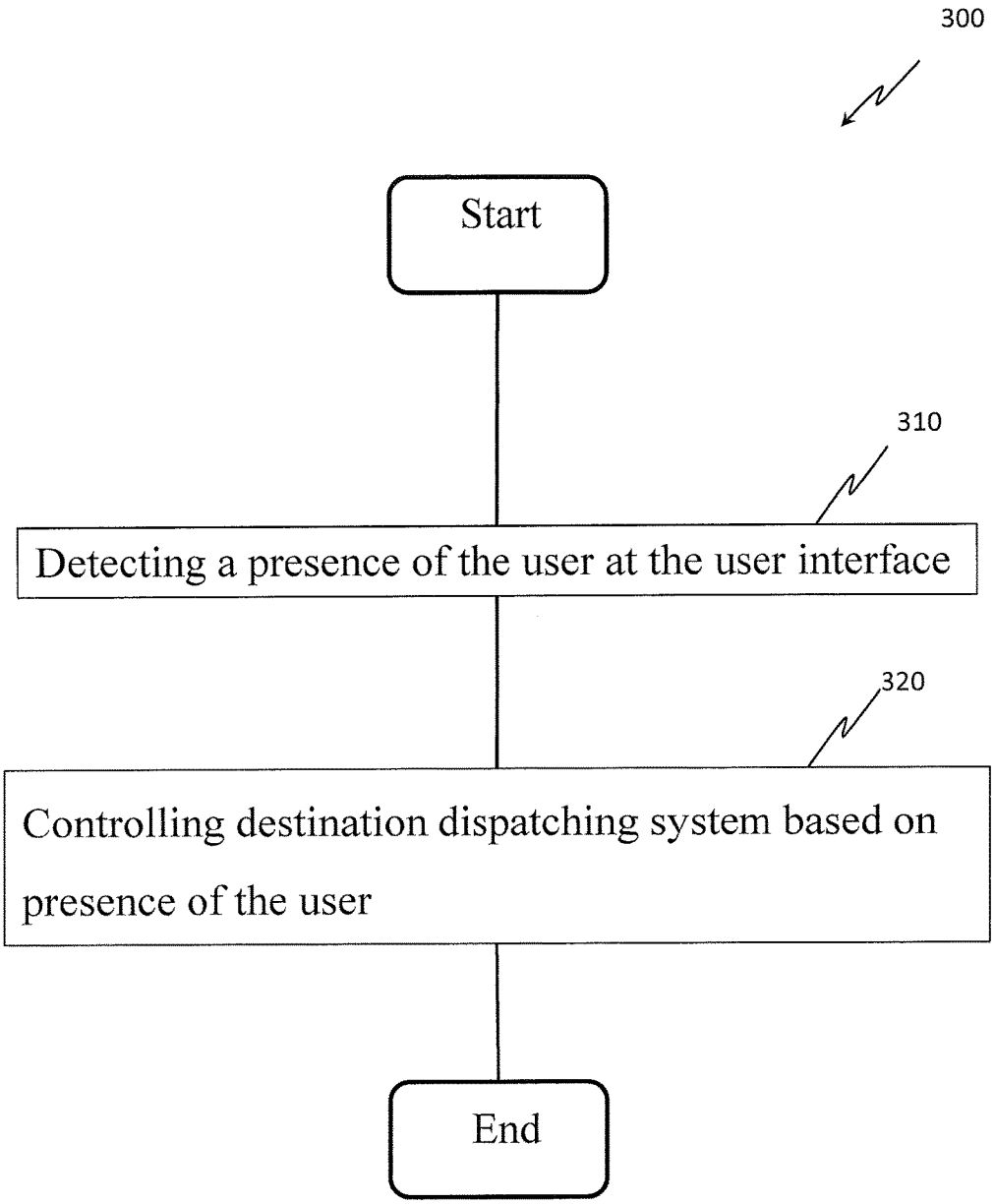
FIG. 3 depicts a method of controlling a destination dispatching system according to another embodiment.

Turning now to FIG. 3 as well. FIG. 3 depicts a method 300 for controlling an elevator system with destination dispatch as described above herein. In an embodiment, in operation 310 a presence detector 120, detects the presence of a user at a user interface 106 of the elevator system 100. Operation 320 describes the controller 102 controlling the elevator system 100 based on the detected presence of the user at the user interface 106. For example, the display 110 and/or input 108 of the user interface may be enabled/disabled or enter a wake/sleep mode when the presence detector 120 determines a user has arrived at/departed from the user interface 106. This feature can be advantageous during periods of light usage such as overnight, resulting in energy savings and reduced wear and tear on the components of the elevator system 100.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

The invention claimed is:

1. An elevator car destination dispatching system, comprising:

a user interface configured to permit a plurality of users to enter a desired destination in a building before entering the elevator car;

a presence detector disposed in the vicinity of the user interface and configured to detect the presence of a first user of the plurality of users at the user interface, the presence detector operably coupled to at least one of a controller or the user interface; and the controller operably coupled to the user interface, the controller configured to dispatch an elevator car based on a first desired destination entered by the first user and the detected presence of the first user, wherein the controller is configured to detect a second desired destination entered by a second user of the plurality of users, determine if the second desired destination is identical to the first desired destination, and determine, using the presence detector, determine whether the second user and first user are the same user.

2. The elevator car dispatching system of claim 1, wherein the controller is configured to ignore the second desired destination if the second desired destination is identical to the first desired destination and the second user and first user are the same user.

3. The elevator car dispatching system of claim 2, wherein the controller is configured to inquire of the second user if they would like to change their destination request if the second user and first user are the same user and the second desired destination is different from the first desired destination.

4. The elevator car dispatching system of claim 3, wherein the controller is configured to modify the activity of a destination dispatching system based on the presence of a user in the vicinity of the user interface.

5. The elevator car dispatching system of claim 1, wherein the presence detector includes at least one of a touch sensor, proximity sensor, PIR sensor, motion detector, radar sensor, electric and magnetic field sensor, optical sensor, and a camera.

6. The elevator car dispatching system of claim 1, wherein the user interface includes at least one of an input device and a display.

7. An elevator car destination dispatching system, comprising:

a user interface configured to permit a plurality of users to enter a desired destination in a building before entering the elevator car;

a presence detector disposed in the vicinity of the user interface and configured to detect the presence of a first user of the plurality of users at the user interface, the presence detector operably coupled to at least one of a controller or the user interface; and the controller operably coupled to the user interface, the controller configured to dispatch an elevator car based on a first desired destination entered by the first user and the detected presence of the first user, wherein the controller is configured to modify the activity of a destination dispatching system based on the presence of a user in the vicinity of the user interface, wherein the modification includes at least one of changing the operation of the user interface based on the presence of a user of the plurality of users in the vicinity of the user interface and collecting data based on the detected presence of the user.

8. The elevator car dispatching system of claim 7, wherein the changing includes at least one of enabling/disabling, wake/sleep mode, and adjusting display timing.

9. A method of dispatching an elevator car in an elevator system, the method comprising:

receiving at a user interface a destination request, before entering the elevator car, the destination request indicative of a desired destination in a building from at least one user of a plurality of users;

detecting a presence of a first user of the plurality of users at the user interface;

dispatching an elevator car based on a first desired destination entered by the first user of the plurality of users and the detected presence of the first user; and detecting a second desired destination entered by a second user of the plurality of users, and determining if the second destination is identical to the first destination and determining whether the second user and the first user are the same user.

10. The method of dispatching an elevator car in an elevator system of claim 9, further comprising ignoring the second destination is identical to the first destination and the second user and the first user are the same user.

11. The method of dispatching an elevator car in an elevator system of claim 10, further comprising inquiring of the second user if they would like to change their destination request if the second user and the first user are the same user and the second desired destination is different from the first desired destination.

12. The method of dispatching an elevator car in an elevator system of claim 11, further comprising modifying the activity of the elevator system based on the presence of a user in the vicinity of the user interface.

13. The method of dispatching an elevator car in an elevator system of claim 9, wherein detecting employs a presence detector including at least one of a touch sensor, proximity sensor, PIR sensor, motion detector, radar sensor, electric and magnetic field sensor, optical sensor, and a camera.

14. The method of dispatching an elevator car in an elevator system of claim 13, wherein the touch sensor is configured as a floor mat that a user stands on proximal to the user interface.

15. A method of dispatching an elevator car in an elevator system, the method comprising:

receiving at a user interface a destination request, before entering the elevator car, the destination request indicative of a desired destination in a building from at least one user of a plurality of users;

detecting a presence of a first user of the plurality of users at the user interface; and dispatching an elevator car based on a first desired destination entered by the first user of the plurality of users and the detected presence of the first user; and modifying the activity of the elevator system based on the presence of a user in the vicinity of the user interface, wherein the modification includes at least one of changing the operation of the user interface based on the presence of a user of the plurality of users in the vicinity of the user interface and collecting data based on the detected presence of the user.

16. The method of dispatching an elevator car in an elevator system of claim 15, wherein the changing includes at least one of enabling/disabling, wake/sleep mode, and adjusting display timing.

* * * * *